United States Patent [19]

Guest

[11] 4,274,798

[45] Jun. 23, 1981

[54] LOADER FORK

[76] Inventor: William H. Guest, 215 - Rte. 10, Dover, N.J. 07801

[21] Appl. No.: 41,816

[22] Filed: May 23, 1979

[51] Int. Cl.[3] ..... B66F 9/12

[52] U.S. Cl. ..... 414/724

[58] Field of Search ..... 414/724, 607; 37/117.5, 37/DIG. 3, DIG. 12

[56] References Cited

U.S. PATENT DOCUMENTS

| | | | |
|---|---|---|---|
| 2,473,505 | 6/1949 | Brock | 37/117.5 |
| 3,325,023 | 6/1967 | Coleman | 414/724 |
| 3,421,642 | 1/1969 | Carter | 414/724 |
| 3,667,633 | 6/1972 | Cappella | 414/724 |
| 3,795,331 | 3/1974 | Guest | 414/724 X |
| 3,908,844 | 9/1975 | Duffield | 414/724 |

*Primary Examiner*—James L. Rowland

*Attorney, Agent, or Firm*—Irvin A. Lavine

[57] ABSTRACT

A loader fork for the bucket of a front end loader having a channel forming a riser, an arm extending rearwardly from the riser and forming a slot for the bucket lip. A thick plate is at the front of the slot for engagement by the bucket cutting edge, a transverse bar is on the bottom of the arm to engage the thick part of the bucket, and the bucket is clamped between a screw carried by the arm and a backing bar at the rear of and wider than the tine. The riser has a bar across its upper end to serve as a handle.

11 Claims, 3 Drawing Figures

LOADER FORK

BACKGROUND OF THE INVENTION

The present invention relates to a fork attachment for the bucket of a front end loader.

There are known in the prior art a number of fork attachments to enable a front end loader to lift loads outwardly of the bucket, in the normal manner of a fork lift. Some require attachment to the upper edge of the bucket, such as Brock U.S. Pat. No. 2,473,505, Carter U.S. Pat. No. 3,421,642, Capella U.S. Pat. No. 3,667,633 and Guest U.S. Pat. No. 3,795,331. These are expensive constructions, and in some instances require either the use of a non-standard bucket, or modification of the bucket. A simpler construction is disclosed in Coleman U.S. Pat. No. 3,325,023 which provides a fork for attachment to a standard bucket, the fork having a forwardly extending prong and rearwardly extending upper and lower clamping lip portions to receive the lip of the bucket between them; this construction is made from steel stock, apparently machined, and has no riser or post to support the load when the lifting prong or tine is inclined. A more economical construction is taught by Duffield U.S. Pat. No. 3,908,844, the fork attachment being made of tubular sections secured perpendicularly by welding to provide a tine and a riser or post; the clamping screw is spaced from the rear end of the tine, there is only a single clamping action, there is no protection against damage by the bucket's cutting edge, and there is a back bearing bar of the same width as the tine.

SUMMARY OF THE INVENTION

A pair of loader forks is provided for attachment to the bucket of a front end loader. Each fork includes a tine and a rearwardly facing channel forming a riser welded to the tine. A bar is attached to the upper end of the riser to form a handle. An upper arm extends rearwardly from the riser, overlying the tine rearwardly of the riser, to provide a slot for entry of the bucket lip. At the front of the slot, a thick transverse bar is provided to be engaged by the bucket cutting edge, to protect the channel, and a bar extends transversely on the underside of the arm, positioned to engage the bucket rearwardly of its thin cutting edge. Clamping of the bucket is provided by a screw clamp, threaded in a nut carried by the upper arm and having in opposed relationship a back bearing bar carried at the rear of the tine.

Among the objects of the present invention are to provide a loader fork of economical construction for a given strength and which is constructed so as not to damage the bucket to which it is attached, nor to be damaged by the bucket, particularly its cutting edge.

DESCRIPTION OF THE PREFERRED EMBODIMENT

Figure 1:
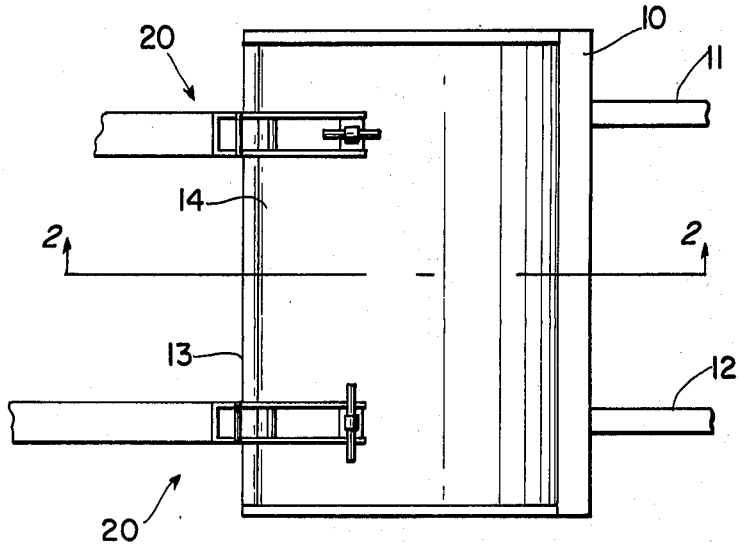
FIG. 1 is a plan view of the bucket of a front end loader with the loader forks of the present invention attached thereto.

Referring now to the drawings, wherein like or corresponding reference numerals are used to designate like or corresponding parts throughout the several views, there is shown in FIG. 1 a bucket 10 of a front end loader which is of standard construction. The bucket 10 is supported by lift arms 11 and 12, and has a leading or cutting edge 13 at its forward end. A pair of loader forks, each generally designated 20 is provided on and attached to the bottom plate 14 of the bucket 10. These may be spaced apart the desired width, and secured in selected positions on the bucket 10.

Figure 2:
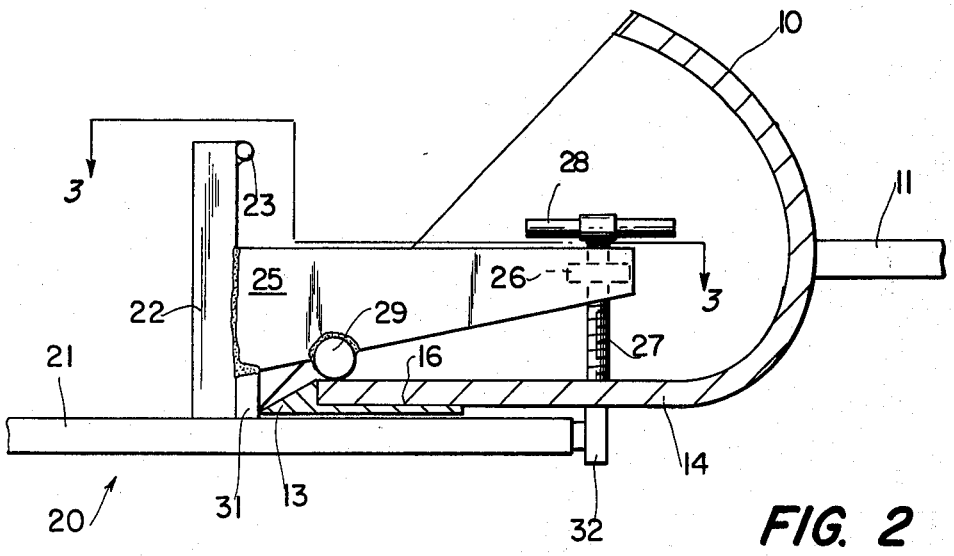
FIG. 2 is a cross sectional view on the line 2—2 of FIG. 1.

Referring now to FIG. 2, there may be seen the bucket 10 and the lift arm 11, as well as the cutting edge 13 thereof. Rearwardly of the cutting edge 13, it will be seen that the bottom plate 14 has a lip portion 16, which may be seen to be substantially thicker than the bottom plate 14 rearwardly thereof.

Figure 3:
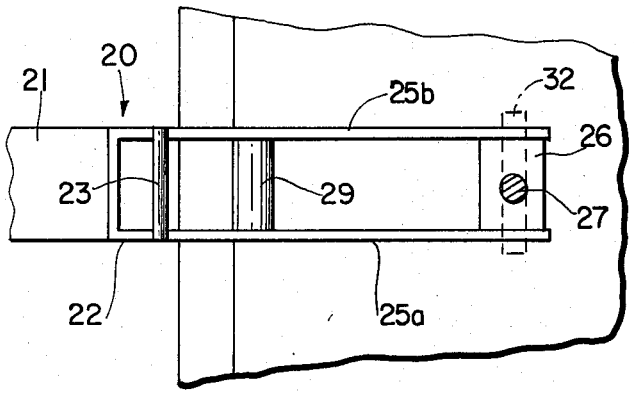
FIG. 3 is a cross sectional view, on an enlarged scale, taken on the line 3—3 of FIG. 2.

The loader fork 20 comprises a tine 21, which is preferably formed from a standard structural steel shape, such as a channel or tube. Welded to the tine 21 is a riser 22, which, as may be seen from FIG. 3, is a rearwardly facing channel; that is, the open portion of the channel which forms the riser 22 faces to the rear. Near its upper end, the riser 22 has a lifting handle 23, in the form of a bar, secured to it, as by welding.

The riser 22, as is clearly shown in FIGS. 1 and 2, is welded to the tine 21 forwardly of the rear end thereof, and extending rearwardly from the riser 22 is an arm 25, formed by a pair of plates **25*a* and 25*b* (See FIG. 3). The arm 25 is located above the rear portion of tine 21, so as to provide a slot between them, to receive the forward part of the bottom plate 14 of the bucket 10. Near their rear ends, the plates 25*a* and 25*b* carry between them a nut 26, into which a screw 27 is threaded; the screw having a handle 28** at its upper end.

On the lower edge of the arm 25, and positioned so as to engage the thick lip portion 16 there is welded a transverse bearing bar 29, which bears against the upper surface of the thick lip portion 16. At the forward end of the slot there is provided a thick plate 31 which is engaged by the cutting edge 13, so as to prevent damage to the loader fork 20, and particularly to the bottom of the riser 22 by the cutting edge 13.

In addition, at the rear of the tine 21, and positioned in opposition to the end of the screw 27, there is a bearing bar 32, which enables the clamping of the thin portion of the bottom plate 14 directly between the bearing bar 32 and the screw 27. It is forwardly of this clamping construction that there is located the bearing bar 29 which engages the thick lip portion 16. Also, as is shown in FIG. 3, the bearing bar 32 has a greater width than the tine 21: it will be seen from FIG. 3 that the width of the tine 21 is approximately the same as the width of the riser 22, and that the plates **25*a* and 25*b* have a space between them which is approximately equal to the width of the tine 21**.

The herein disclosed loader fork 20 has been particularly constructed so as to cooperate with the specific features of a conventional bucket, such as shown in FIG. 2, and a number of significant advantages are obtained from the present construction. Thus, a relatively light riser construction, being formed of a channel, is utilized, but for given loads, the light weight and inexpensive riser is able to withstand the loads placed against it, as when the tine 21 is inclined, by virtue of the fact that the arm 25 reacts the load by engagement of both the screw 27 and the bearing bar 29 on the bottom 14 of the bucket. Thereby, sufficient strength is obtained with an inexpensive construction. The loader fork 20 is protected against damage from the cutting edge of the bucket 13, by virtue of the provision of the heavy bar 31, thereby avoiding damage to the riser 22 by the cutting edge 13. The construction herein disclosed avoids bending the lip of the bucket 10, due to the fact that the bearing bar 29 engages the thick lip portion 16, and is thus specifically engaging the bucket 10 at a place spaced from the thin leading or cutting edge 13 which could become damaged with other constructions. Further, the back bearing bar 32, being of relatively greater width than the tine 21, provides additional contact area, and the fact that there is the positioning of the screw 27 directly opposite the back bearing bar 32 provides for a clamping action which will avoid bending of the bottom plate 14 of the bucket 10.

It will be obvious to those skilled in the art that various changes may be made without departing from the spirit of the invention, and therefore the invention is not limited to what is shown in the drawings and described in the specification but only as indicated in the appended claims.

I claim:

1. A loader fork for attachment to a bucket of a front end loader, the bucket having a bottom plate with a cutting edge and a thick lip portion rearwardly thereof, the loader fork comprising:

a tine, a riser secured to the tine, the arm above the tine extending rearwardly from the riser to provide a slot, said riser being a rearwardly facing channel, and means for distributing loads acting against said riser into said bucket bottom plate comprising:

bearing bar means extending transversely of said arm rearwardly of said riser, and positioned to engage the upper surface of the thick lip portion of the bucket, and clamp means for clamping said tine against the bottom surface of said bottom plate comprising a screw carried by said arm and located rearwardly of said bearing bar means.

2. The loader fork of claim 1, said tine at its rear end having bottom plate engaging means comprising a bar transverse to and wider than the tine, and said screw being opposite said bar on said tine.

3. The loader fork of claim 2, and a lifting handle at the upper end of said riser.

4. The loader fork of claim 3, said lifting handle comprising a bar across the flanges of said channel.

5. The loader fork of claim 1, and further comprising means for engagement by the cutting edge of the bucket bottom plate when said fork is attached comprising a thick plate at the forward portion of the slot.

6. The loader fork of claim 1, said clamp means comprising a bar transverse to and wider than the tine at the rear thereof, and said screw being opposite said bar on said tine.

7. The loader fork of claim 1, and a lifting handle at the upper end of said riser.

8. The loader fork of claim 7, said lifting handle comprising a bar across the flanges of said channel.

9. A loader for attachment to a bucket for a front end loader, the bucket having a bottom plate with a cutting edge and a thick lip portion rearwardly thereof, the loader fork comprising:

a tine, a riser secured to the tine, an arm above the tine extending rearwardly from the riser to provide a slot, means for securing said loader fork to said bucket bottom plate comprising:

bearing bar means extending transversely of said arm rearwardly of said riser and positioned to engage the upper surface of the thick lip portion of the bucket, and clamp means for clamping said tine against the bottom surface of said bottom plate comprising a screw carried by said arm and located rearwardly of said bearing bar means.

10. The loader fork of claim 9, and further comprising means for engagement by the cutting edge of the bucket bottom plate when said fork is attached comprising a thick plate at the forward portion of the slot.

11. The loader fork of claim 9, said tine at its rear end having bottom plate engaging means comprising a bar transverse to and wider then the tine, and said screw being opposite said bar on said tine.

* * * * *